US009617882B1

(12) United States Patent
Hörr

(10) Patent No.: US 9,617,882 B1
(45) Date of Patent: Apr. 11, 2017

(54) MUFFLER FOR AN EXHAUST SYSTEM

(71) Applicant: Eberspächer Exhaust Technology GmbH & Co. KG, Neunkirchen (DE)

(72) Inventor: Micha Hörr, Schorndorf (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 15/238,138

(22) Filed: Aug. 16, 2016

(30) Foreign Application Priority Data

Nov. 10, 2015 (DE) ..... 10 2015 222 088

(51) Int. Cl.
*F01N 1/16* (2006.01)
*F01N 1/04* (2006.01)
*F01N 1/24* (2006.01)

(52) U.S. Cl.
CPC ..... *F01N 1/163* (2013.01); *F01N 1/04* (2013.01); *F01N 1/24* (2013.01); *F01N 2410/10* (2013.01); *F01N 2470/24* (2013.01)

(58) Field of Classification Search
CPC .. F01N 1/163; F01N 2410/10; F01N 2470/14; F01N 2470/24
USPC ..... 181/238, 239, 241, 249, 253, 254, 255, 181/269
See application file for complete search history.

(56) References Cited

U.S. PATENT DOCUMENTS 4,501,341 A * 2/1985 Jones ..... F01N 1/006 181/250
4,913,260 A * 4/1990 Fallon ..... F01N 1/02 137/487.5
4,924,966 A * 5/1990 Kanda ..... F01N 1/02 181/228
5,602,368 A * 2/1997 Kaneso ..... F01N 1/003 181/250
7,337,609 B2 * 3/2008 Mahnken ..... F01N 1/165 181/237
8,579,077 B2 * 11/2013 Ahn ..... F01N 13/08 181/212
2007/0045043 A1 3/2007 Hoerr et al.
2007/0158135 A1 * 7/2007 Shimomura ..... F01N 1/08 181/251
2015/0354421 A1 * 12/2015 Horr ..... F01N 1/166 181/241

FOREIGN PATENT DOCUMENTS

DE 10 2005 041 692 A1 3/2007
JP 2005 256 736 A 9/2005

* cited by examiner

*Primary Examiner* — Jeremy Luks
(74) *Attorney, Agent, or Firm* — McGlew and Tuttle, P.C.

(57) ABSTRACT

A muffler (1) for an exhaust system of an internal combustion engine has a housing (2) with an expansion chamber (6). An inlet pipe (7) extends into the housing (2) and has an end section (8) with an outlet opening (9) to the expansion chamber (6). A main outlet pipe (10) has an initial section (11) protruding into the end section (8) of the inlet pipe (7). A secondary outlet pipe (15) has an inlet opening (16) in the expansion chamber (6). A gap (14) in an overlapping area (13) between the end section (8) and the initial section (11) forms a bypass in the end section (8) of the inlet pipe (7), which bypasses the initial section (11) of the main outlet pipe (10). Through the bypass gap (14), exhaust gas flows from the inlet pipe (7) into the expansion chamber (6) and out the secondary outlet pipe (15).

20 Claims, 1 Drawing Sheet

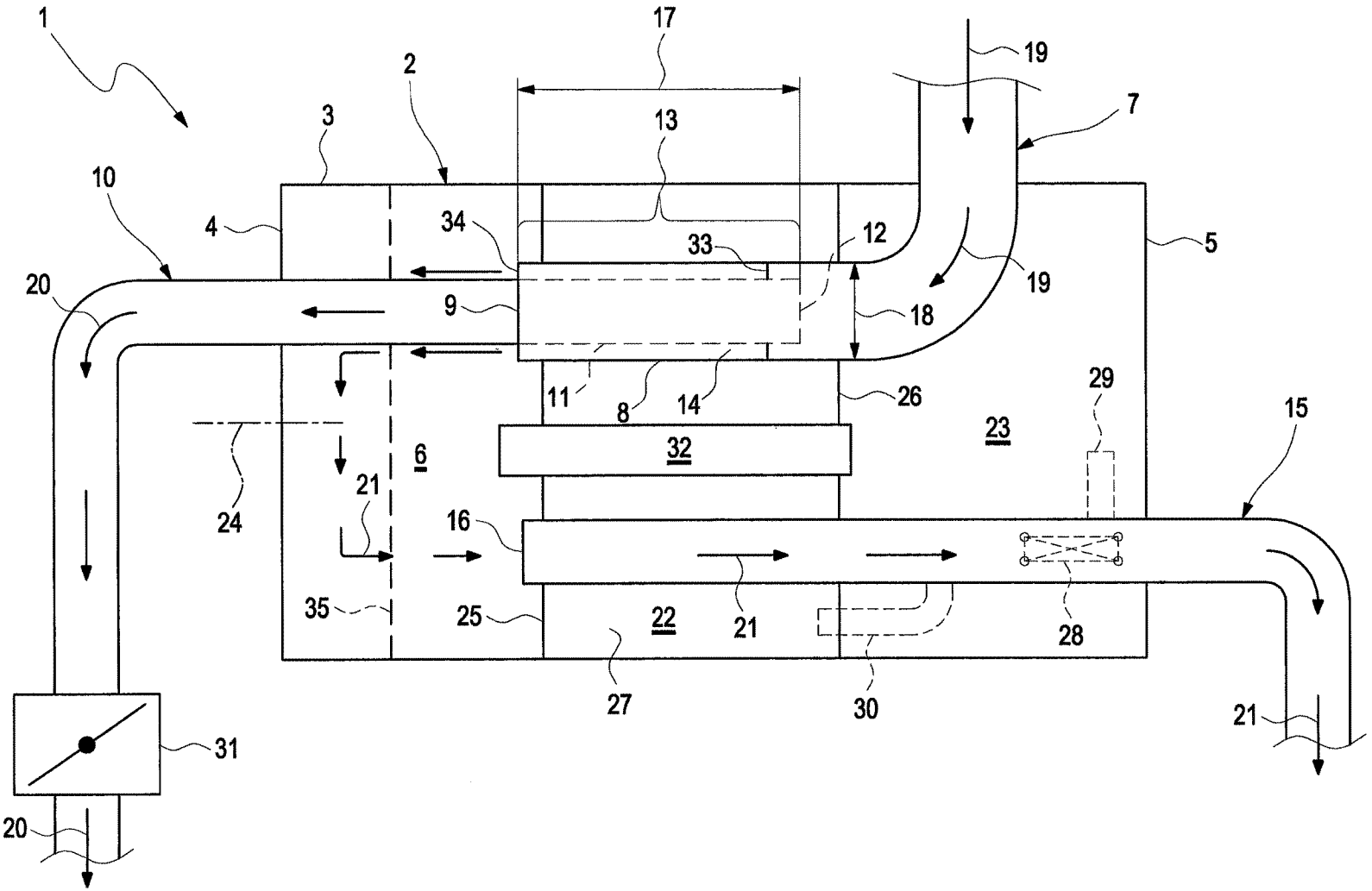
1
2
3
4
5
6
7
8
9
10
11
12
13
14
15
16
17
18
19
20
21
22
23
24
25
26
27
28
29
30
31
32
33
34
35

MUFFLER FOR AN EXHAUST SYSTEM

CROSS REFERENCE TO RELATED APPLICATIONS

This application claims the benefit of priority under 35 U.S.C. §119 of German Patent Application 10 2015 222 088.5 filed Nov. 10, 2015, the entire contents of which are incorporated herein by reference.

FIELD OF THE INVENTION

The present invention pertains to a muffler for an exhaust system of an internal combustion engine, especially of a road vehicle, especially an automobile. The present invention pertains, in addition, to an exhaust system equipped with such a muffler for an internal combustion engine.

BACKGROUND OF THE INVENTION

In sporty automobiles, especially in sports cars, there often is a need for obtaining an acoustic feedback on the current operating state of the vehicle or of the internal combustion engine. This need occurs above all during acceleration processes, i.e., at upper partial loads as well as at full load of the internal combustion engine. Therefore, a comparatively slight muffling is desired in these operating states. At the same time, the lowest possible exhaust gas back pressure is desired for these operating states in the muffler for the exhaust gas flow in order to be able to obtain the largest amount of power from the internal combustion engine for propelling the vehicle. In contrast to this, it is necessary to achieve the most efficient acoustic muffling possible at a low partial load of the internal combustion engine, especially at idle. Since there is a large excess of power in this operating range of the internal combustion engine, a relatively high back pressure can also be accepted for this in the muffler.

In order for a muffler to be able to meet these conflicting requirements, it is possible to embody in the muffler two exhaust gas paths, one of which can be controlled by means of a control device, while the other is usually uncontrolled. The controllable exhaust gas path is opened at full load, as a result of which the exhaust gas back pressure decreases, By corresponding routing of this controlled exhaust gas path, reduced muffling can also be achieved in this manner. By contrast, the controllable exhaust gas path is blocked at low load, so that the exhaust gas flows only through the uncontrolled path and is efficiently muffled therein. It is, however, problematic in such systems that a comparatively efficient acoustic coupling of the controllable, opened exhaust gas path with the acoustic muffling devices of the muffler is also given at full load, so that a certain muffling is still brought about even at full load.

SUMMARY OF THE INVENTION

An object of the present invention is to provide an improved embodiment for a muffler of the above-described type, which is characterized especially in that an acoustic coupling of an exhaust gas path, which is active at full load, with muffling devices of the muffler is reduced.

This object is accomplished according to the present invention by a muffler for an exhaust system of an internal combustion engine that comprises a housing, in which an expansion chamber is formed with an inlet pipe extending into the housing and introducing exhaust gas into the housing, the inlet pipe having an end section with an outlet opening in the expansion chamber and a main outlet pipe extending into the housing and removing exhaust gas from the housing, the main outlet pipe having an initial section which protrudes into the end section of the inlet pipe. A gap is formed in an overlapping area between the end section of the inlet pipe and the initial section of the main outlet pipe and which forms a bypass, through which exhaust gas can flow from the inlet pipe into the expansion chamber, which bypass bypasses the initial section of the main outlet pipe in the end section of the inlet pipe. A secondary outlet pipe has an inlet opening in the expansion chamber and removes exhaust gas from the housing.

The present invention is based on the general idea of forming an overlapping area between an inlet pipe and a main outlet pipe, in which the inlet pipe and the main outlet pipe are inserted one into another, such that a bypass, through which exhaust gas can flow out into an expansion chamber from the inlet pipe past the main outlet pipe, is formed in this overlapping area between the inlet pipe and the main outlet pipe. In addition, a secondary outlet pipe, through which exhaust gas can flow out of the expansion chamber, opens into this expansion chamber. It is achieved due to the pipe-in-pipe arrangement provided according to the present invention that the inlet pipe and the main outlet pipe act quasi as a continuous exhaust pipe for a part of the exhaust gas stream, which is extensively uncoupled from muffling devices of the muffler, as a result of which low muffling as well as a low exhaust gas back pressure can be achieved for this part of the exhaust gas flow. The rest of the exhaust gas flow flows, by contrast, through the bypass into the expansion chamber and through the secondary outlet pipe and out of the muffler. Efficient muffling takes place for this part of the exhaust gas flow by means of the expansion chamber.

An expansion chamber is characterized, in general, by a free space, into which airborne sound can propagate. Just like in an absorption chamber, sound-absorbing material may be arranged, in principle, in an expansion chamber, but such an expansion chamber is not filled completely with sound-absorbing material, but a free space, into which airborne sound can expand, e.g., through the bypass or through a perforation, must rather remain within the expansion chamber.

Further, it was found that the use of the main outlet pipe as a resonance tube, for example, in the form of a $\lambda/4$ pipe or of a $\lambda/2$ pipe, is improved by means of such an overlapping area, in which an initial area of the main outlet pipe protrudes into an end area of the inlet pipe, because an especially efficient vibration excitation can be achieved in the overlapping area. The main outlet pipe can be inserted here specifically so deeply into the inlet pipe that an optimal vibration excitation will become established in the main outlet pipe.

According to an advantageous embodiment, the end section of the inlet pipe and the initial section of the main outlet pipe may have a straight configuration. An axial length of the overlapping area, with which the main outlet pipe protrudes into the inlet pipe, may advantageously be twice and especially at least three times or at least four times the diameter of the end section of the inlet pipe. A predefined flow, which has, for example, a predefined flow resistance, is obtained hereby in a gap, which is formed radially between the end section of the inlet pipe and the initial section of the main outlet pipe and forms the aforementioned bypass.

According to an especially advantageous embodiment, the flow cross sections and/or the flow resistances of the main outlet pipe, secondary outlet pipe and the gap are coordinated with one another such that 40% to 60% of the exhaust gas stream fed via the inlet pipe is removed through the main outlet pipe. A flow splitting tat 50:50 between the main outlet pipe and the secondary outlet pipe is preferred. It was found that, for example, a control device for controlling the flow through the main outlet pipe can be eliminated in case of such a flow splitting. The effort needed for manufacturing such a muffler correspondingly decreases. The main outlet pipe and the secondary outlet pipe are not controlled in this case and exhaust gas flows permanently through them during the operation of the muffler.

Provisions may be made in another advantageous embodiment for a flow cross section of the gap in the overlapping area to be, on average, about equal to a flow cross section of the main outlet pipe. At such a ratio of the flow cross sections of the main outlet pipe and the gap, the exhaust gas flow is split at about 50:50 between the main outlet pipe and the secondary outlet pipe in case of a homogenous flow in the inlet pipe upstream of the overlapping area.

In another advantageous embodiment, the housing may have a cylindrical configuration and be equipped with a jacket as well as with two end panels. The inlet pipe is advantageously passed through the jacket. The main outlet pipe is advantageously passed through the one end panel. The secondary outlet pipe is advantageously passed through the other end panel. As a result, the muffler can be configured especially as a transversely arranged muffler, which is arranged with its central longitudinal axis at right angles to a longitudinal axis of the vehicle in the installed state. The outlet pipes exiting the housing at opposite axial ends may now form two tail pipes of the exhaust system or lead to two tail pipes. As an alternative, provisions may also be made for the main outlet pipe and the secondary outlet pipe to be led out of the housing through the same end panel. It is likewise conceivable to embody the housing as a shell construction.

Provisions may advantageously be made for the inlet pipe to be unperforated. Efficient flow routing to the main outlet pipe is achieved hereby. In addition or as an alternative, the main outlet pipe may be unperforated. This measure also ensures efficient flow routing within the main outlet pipe. In addition or as an alternative, the secondary outlet pipe may be unperforated. This measure also ensures that the flow routing is especially efficient in the secondary outlet pipe. If all three above-mentioned pipes in the housing are unperforated, the housing advantageously contains only the expansion chamber.

In another embodiment, the main outlet pipe has a perforation in the expansion chamber. It is achieved hereby that airborne sound being carried in the exhaust gas stream can escape into the expansion chamber through the perforation of the main outlet pipe, as a result of which a certain muffling can be achieved. In addition or as an alternative, the inlet pipe may have a perforation in the overlapping area, as a result of which an acoustic coupling to a space enveloping the overlapping area is created.

At least one additional chamber may be formed in the housing in another advantageous embodiment. The inlet pipe and/or the secondary outlet pipe may have a perforation in such an additional chamber. The respective additional chamber is acoustically connected hereby via the respective perforation and can be used to muffle the airborne sound being carried. For example, the inlet pipe may have a perforation in the overlapping area.

According to an especially advantageous embodiment, two additional chambers, namely, a first additional chamber, which axially adjoins the expansion chamber, as well as a second additional chamber, which axially adjoins the first additional chamber on a side facing away from the expansion chamber, may be formed in the housing. Provisions may now advantageously be made for the secondary outlet pipe to have a perforation in the second additional chamber. As a result, the second additional chamber is acoustically coupled via the perforation of the secondary outlet pipe. The second additional chamber may be configured, for example, as an absorption chamber, which is filled with sound-absorbing material. It is likewise conceivable that the second additional chamber is likewise configured as an expansion chamber.

According to an advantageous variant, the first additional chamber may be configured as an absorption chamber, which is filled with sound-absorbing material. The first additional chamber may be separated from the expansion chamber by means of a first partition and from the second additional chamber by means of a second partition. The partitions are arranged here axially between the end panels and are located at axially spaced locations from these as well as from one another. The acoustic connection of the first additional chamber acting as an absorption chamber may be brought about via a perforation in the inlet pipe or via a perforation in the secondary outlet pipe or via a perforation in the first partition or via a perforation in the second partition. It is likewise conceivable that the acoustic coupling is achieved by a combination of the above perforations. Conceivable is, furthermore, that the inlet pipe is passed through the first partition and is unperforated in the first additional chamber.

In a preferred embodiment, the first partition may be perforated, so that the first additional chamber is acoustically coupled with the expansion chamber. If the second partition is unperforated, the first additional chamber is acoustically coupled with the expansion chamber through the first partition. As an alternative, the second partition may also be provided with a perforation, so that the first additional chamber is acoustically coupled with the expansion chamber and with the second additional chamber.

By contrast, provisions are made in an alternative embodiment for the first partition to be unperforated, while the second partition is perforated, so that the acoustic connection of the first additional chamber to the second additional chamber is established through the second partition. Further, the inlet pipe and the secondary outlet pipe are now unperforated in the first additional chamber, while the secondary outlet pipe has a perforation in the second additional chamber. The second additional chamber is advantageously configured in this case as an expansion chamber, so that airborne sound can reach the perforated second partition through a free space in the expansion chamber.

A preferred embodiment is obtained if an absorption chamber adjoins the expansion chamber and if a resonance chamber adjoins the absorption chamber. The absorption chamber can be acoustically connected to the expansion chamber through a perforation of the first partition. The inlet pipe may likewise have a perforation in the overlapping area, which is located in the absorption chamber. The resonance chamber may be connected acoustically to the expansion chamber via a connection pipe, in which case the connection pipe passes through both partitions. The second partition is advantageously unperforated. The secondary outlet pipe and the main outlet pipe are advantageously unperforated in this embodiment.

Especially advantageous is, however, an embodiment in which two additional chambers, namely, a first additional chamber, which axially adjoins the expansion chamber via a first partition, and a second additional chamber, which axially adjoins the first additional chamber via a second partition on a side facing away from the expansion chamber, are formed in the housing, wherein the first additional chamber is configured as an absorption chamber, which is filled with a sound-absorbing material and is acoustically coupled with the expansion chamber through the first partition having a perforated configuration, and wherein the second additional chamber is configured as a resonance chamber, which is separated from the first additional chamber by means of the second partition having an unperforated configuration and is acoustically connected to the secondary outlet pipe or to the expansion chamber via a resonator tube. A broad-band muffling can thus be achieved by means of expansion, absorption and resonance via the secondary path.

The main outlet line and the secondary outlet line advantageously extend parallel to one another within the housing. The pipes are advantageously arranged within the housing such that the exhaust gas must be deflected by 180° in the expansion chamber from the outlet opening of the gap during the operation of the internal combustion engine in order to be able to enter the secondary outlet pipe through the inlet opening of the secondary outlet pipe. If the two outlet pipes are led out of the housing through the same end panel, the inlet opening of the secondary outlet pipe and the outlet opening of the gap are advantageously arranged such that the flow must be deflected by 180° twice in the expansion chamber in order to reach the inlet opening of the secondary outlet pipe from the outlet opening of the gap.

The main outlet pipe is advantageously supported radially at the inlet pipe in the overlapping area in order to reduce relative motions between the inlet pipe and the main outlet pipe. The main outlet pipe may be supported for this purpose via a plurality of webs at the inlet pipe, which are arranged distributed in the circumferential direction of the main outlet pipe and bridge over the gap. In addition or as an alternative, provisions may be made for the main outlet pipe to be supported at the inlet pipe via at least one perforated ring, which extends in the circumferential direction of the main outlet pipe and fills the gap. Significant stabilization, which can be achieved at a comparatively low cost, is attained in both cases.

In addition, provisions may be made for the main outlet pipe to be supported at a perforated intermediate panel, which is arranged in the expansion chamber and is supported at the housing. This measure also stabilizes the position of the main outlet pipe in the housing. The perforated intermediate panel does not lead to an acoustic separation within the expansion chamber, so that this is preserved as one unit.

According to an advantageous variant, the main outlet pipe can be controlled in terms of the flow of exhaust gas through it by means of a control device. This control device may be coupled with the main outlet pipe within the housing or outside the latter. This control device may be configured especially such that it opens the main outlet pipe at least at full load of the internal combustion engine and that it blocks the main outlet pipe at least at a low partial load of the internal combustion engine. Control devices are likewise conceivable in which one, more or any desired number of intermediate positions can be obtained. The control device may be configured here such that it operates actively, i.e., is equipped with an actuating drive, or that it operates passively and is consequently adjusted only by displacement forces of the flow. A semi-active configuration of the control device, which operates, for example, with a pressure chamber and is controlled by the pressure that prevails in the inlet pipe and/or in the expansion chamber and/or in the initial area of the main outlet pipe, is also conceivable.

It is apparent that the above-described features, which will also be explained below, are applicable not only in the particular combination indicated, but also in other combinations or alone, without going beyond the scope of the present invention.

Preferred exemplary embodiments of the present invention are shown in the drawings and will be explained in more detail in the following description. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWING

In the drawing:

FIG. 1 is a highly simplified, circuit-diagram-like general view of a muffler.

DESCRIPTION OF THE PREFERRED EMBODIMENTS

Referring to the drawings, corresponding to FIG. 1, a muffler 1, which is intended for an exhaust system of an internal combustion engine, comprises a housing 2, which preferably has a cylindrical configuration and correspondingly has a cylindrical jacket 3 and, at its axial ends, an end panel each, namely, a first end panel 4 and a second end panel 5. The exhaust system and the internal combustion engine are advantageously arranged in a road vehicle. The vehicle is preferably an automobile, especially a sports car.

An expansion chamber 6 is formed in the housing 2. This expansion chamber is characterized by a free space, into which exhaust gas and airborne sound being carried by same can expand. Sound-absorbing material may optionally be arranged in the expansion chamber 6 outside this free space, e.g., along limiting walls.

The muffler 1 is equipped with an inlet pipe 7, which has in the housing 2 an end section 8, with which the inlet pipe 7 ends in the expansion chamber 6. The end section 8 has an outlet opening 9 for this in the expansion chamber 6. Further, the muffler 1 is equipped with a main outlet pipe 10, which has an initial section 11 in the housing 2. This initial section 11 is inserted into the end section 8 of the inlet pipe 7 and ends in the interior of the inlet pipe 7. The initial section 11 is correspondingly shown in FIG. 1 with broken line only. The initial section 11 has an inlet opening 12 within the inlet pipe 7. Since the initial section 11 of the main outlet pipe 10 protrudes into the end section 8 of the inlet pipe 7, an overlapping area 13, which is indicated by a curly bracket in FIG. 1, is formed between the end section 8 and the initial section 11. A gap 14 is formed in this overlapping area 13 radially between the end section 8 and the initial section 11. This gap 14 forms, in turn, a bypass, which bypasses the initial section 11 within the end section 8. Exhaust gas can thus flow through the gap 14 from the inlet pipe 7 past the initial section 11 on the outside into the expansion chamber 6. Finally, the muffler 1 has, in addition, a secondary connection pipe 15, which has an inlet opening 16 in the expansion chamber 6.

The end section 8 of the inlet pipe 7 and the initial section 11 of the main outlet pipe 10 advantageously extend as straight sections, so that the overlapping area 13 is straight as well. The initial section 11 axially protrudes into the end section 8 to the extent that the overlapping area 13 has an axial length 17 that is about four times the diameter 18 of the inlet pipe 7 in the end section 8 in the example being shown. A resonance effect, with which a certain frequency of the sound being transported in the exhaust gas can be muffled, can be optimized in the main outlet pipe 10 by the insertion depth or by the length 17 of the overlapping area 13.

The flow cross sections and flow resistances of the main outlet line 10, of the secondary outlet line 15 and of the gap 14 are advantageously coordinated with one another such that a predefined split of an exhaust gas stream 19 being fed via the inlet pipe 7 into a primary partial stream 20 removed through the main outlet pipe 10 and a secondary partial stream 21 being removed through the secondary outlet pipe 15 becomes established at least at partial load and/or full load of the internal combustion engine. The global flow 19 being fed, namely, the main partial stream 20 and the secondary partial stream 21, are indicated by arrows in FIG. 1. A split of the global stream 19 to the primary partial stream 20 and the secondary partial stream 21 that is in a range of 40:60 to 60:40 is preferably set. A split of about 50:50 is especially advantageous.

To achieve a splitting of the global stream 19 into the primary partial stream 20 and the secondary partial stream 21, provisions may be made for selecting in the overlapping area 13 the flow cross section of the gap 14 to be, on average, about equal to the flow cross section of the main outlet pipe 10 in the initial section 11. The flow cross sections of the gap 14 and of the initial section 11 are accordingly always about half the flow cross section of the inlet pipe 7 directly upstream of the inlet opening 12 of the main outlet pipe 10.

Even though a concentric arrangement of the initial section 11 and end section 8, which leads to a gap 14 extending fully in a ring-shaped pattern around the initial section 11, is shown in FIG. 1, any desired eccentric arrangement may, in principle, be selected. It is also conceivable, in particular, that the initial section 11 linearly touches the end section 8. It is likewise conceivable that the end section 8 and the initial section 11 have a common wall section, which is limited in the circumferential direction of the overlapping area 13. The gap 14 may also have different geometries depending on the cross-sectional geometry of the initial section 11 and end section 8 in the overlapping area 13. It may be, e.g., ring-shaped or C-shaped in case of round pipe cross sections and U-shaped or I-shaped in case of angular, preferably rectangular, pipe cross sections.

The inlet pipe 7 is passed through the jacket 3 in the preferred embodiment being shown here with cylindrical housing 2, while the outlet pipes 10 and 15 are passed through the end panels 4, 5. Specifically, the main outlet pipe 10 is passed through the first end panel 4, while the secondary outlet pipe 15 is passed through the second end panel 5. Provisions may also be made, as an alternative, for both outlet pipes 10, 15 to be passed through the same end panel 4 or 5.

Furthermore, two additional chambers, namely, a first additional chamber 22 and a second additional chamber 23, are formed in the housing 2 in the embodiment being shown here. The first additional chamber 22 axially adjoins the expansion chamber 6. The second additional chamber 23 axially adjoins the first additional chamber 22 on a side facing away from the expansion chamber 6. The axial direction is defined here by a central longitudinal axis 24 of the cylindrical housing 2. The first additional chamber 22 is separated from the expansion chamber 6 by means of a first partition 25 and is separated from the second additional chamber 23 by means of a second partition 26. Preferred is an embodiment in which the first additional chamber 22 is configured as an absorption chamber and is filled with a sound-absorbing material 27. The first additional chamber 22 is preferably filled completely with a sound-absorbing material 27. Further, the first partition 25 is preferably perforated. The first additional chamber 22 is thus acoustically connected to the expansion chamber 6. The inlet pipe 7 and the secondary outlet pipe 15 pass through the first partition 25 here. The second partition 26 is preferably configured as an unperforated partition. The second additional chamber 23 may preferably be configured as an expansion chamber or as an absorption chamber or as a resonance chamber. Furthermore, an embodiment is preferred, in which the inlet pipe 7 and the main outlet pipe 10 are unperforated. Contrary to this, the secondary outlet pipe 15 in the second additional chamber 23 may be provided with a perforation 28, whereby the second additional chamber 23 is acoustically coupled with the secondary outlet pipe 15. The secondary outlet pipe 15 may be unperforated in the first additional chamber 22 or have an additional perforation, not shown here. In connection with the perforation 28, the second additional chamber 23 forms an additional expansion chamber.

Instead of the perforation 28 shown, a resonator tube 29 indicated by a broken line, which forms a Helmholtz resonator in connection with the free volume of the second additional chamber 23, may also be provided at the secondary outlet pipe 15.

Provisions may preferably also be made for using a resonator tube 32 for acoustically connecting the expansion chamber 6 to the second additional chamber 23 in order to form such a Helmholtz resonator. The second additional chamber 23 is a resonator chamber in this case as well. The resonator tube 32 passes through the perforated first partition 25 and the unperforated second partition 26 as well as the first additional chamber 22, which acts as an absorption chamber in this case. Further, the secondary outlet pipe 15 and the inlet pipe 7 are unperforated in this case at least in the second additional chamber 23.

It is likewise conceivable, as an alternative, to provide, in addition to the perforation 28, a connection pipe 30, which is likewise indicated by an interrupted line only in FIG. 1. This connection pipe 30 will then interact with the free volume of the first additional chamber 22 as a Helmholtz resonator. It may be advantageous in this case to configure the second additional chamber 23, which is acoustically connected to the secondary outlet line 15 via the perforation 28, as an absorption chamber, which is then filled with sound-absorbing material 27.

In addition, FIG. 1 indicates a control device 31, by means of which the ability of exhaust gas to flow through the main outlet pipe 10 can be controlled. In particular, the splitting of the global stream 19 into the primary partial stream 20 and the secondary partial stream 21 can be varied hereby. For example, the control device 31 can open the main outlet pipe 10 at full load of the internal combustion engine, so that a comparatively large primary partial stream 20 will develop. In a lower partial load range, the control device 31 may, by contrast, bring about a blocking of the main outlet pipe 10, so that a comparatively large secondary partial stream 21, which corresponds to the global stream 19 in the extreme case, will then develop. This optional control device 31 is arranged outside the housing 2 in the example being shown. In another embodiment, the control device 31 may also be arranged on the housing 2 or in the housing 2.

Provisions are made, in addition, according to FIG. 1 for the main outlet pipe 10 to be radially supported in the overlapping area 13 at the inlet pipe 7. This is accomplished in the example being shown in the area of the inlet opening 12 of the main outlet pipe 10 by means of a plurality of webs 33, which support the main outlet pipe 10 at the inlet pipe 7 and which are arranged distributed in the circumferential direction of the main outlet pipe 10 and at spaced locations from one another and bridge over the gap 14. In addition, a perforated ring 34 is provided in the example in the area of the outlet opening 9 of the inlet pipe 7, wherein the main outlet pipe 10 is supported via said ring at the inlet pipe 7 and said ring extends in the circumferential direction of the main outlet pipe 10 and fills the gap 14. Finally, provisions are made here, in addition or alternatively, for the main outlet pipe 10 to be supported at a perforated intermediate panel 35, which is arranged in the expansion chamber 6 and is supported at the housing 2.

Thus, a pipe-in-pipe arrangement of the inlet pipe 7 and main outlet pipe 10, which arrangement makes possible a quasi uninterrupted flow through the housing 2 if the main outlet pipe 10 is opened, is thus created in the overlapping area 13. A main exhaust gas path is thus created by this pipe-in-pipe arrangement through the housing 2. If, in addition, the inlet pipe 7 and the main outlet pipe 10 are unperforated and the end section 8 and, in particular, the initial section 11 are also unperforated in the overlapping area 13, there is only a very weak acoustic coupling via this quasi contiguous pipe with the acoustic muffling devices of the muffler 1. In particular, only a comparatively small volume of the muffler 1 is coupled to this main path. These acoustic muffling devices are, for example, as was explained above, the expansion chamber 6, the first additional chamber 22 and the second additional chamber 23, which may optionally act as an expansion chamber, as an absorption chamber and as a resonance chamber of a Helmholtz resonator. With the main outlet pipe 10 opened, the airborne sound being carried in the global stream 19 can leave the muffler 1 through the main outlet pipe 10 largely unmuffled along the main exhaust gas path, as a result of which the driver of the vehicle receives the desired feedback. If, by contrast, the main outlet pipe 10 is closed, the airborne sound being carried in the global stream 19 is forced to follow the secondary exhaust gas path passed through the secondary outlet pipe 15, while all muffling devices provided are active and correspondingly bring about an efficient muffling of the airborne sound being carried. Further, the coupling of the main outlet pipe 10 acting as a resonance tube can be optimized by the pipe-in-pipe arrangement.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a housing, in which an expansion chamber is formed;

an inlet pipe extending into the housing and introducing exhaust gas into the housing, the inlet pipe having an end section with an outlet opening in the expansion chamber;

a main outlet pipe extending into the housing and removing exhaust gas from the housing, the main outlet pipe having an initial section which protrudes into the end section of the inlet pipe;

a gap formed in an overlapping area between the end section of the inlet pipe and the initial section of the main outlet pipe and which forms a bypass, through which exhaust gas can flow from the inlet pipe into the expansion chamber, which bypass bypasses the initial section of the main outlet pipe in the end section of the inlet pipe; and a secondary outlet pipe having an inlet opening in the expansion chamber and removing exhaust gas from the housing.

2. A muffler in accordance with claim 1, wherein:

the end section of the inlet pipe and the initial section of the main outlet pipe each have a straight configuration; and an axial length of the overlapping area is at least twice a diameter of the end section of the inlet pipe.

3. A muffler in accordance with claim 1, wherein flow cross sections or flow resistances or both flow cross sections and flow resistances of the main outlet pipe, the secondary outlet pipe and the gap are coordinated with one another such that 40% to 60% of the exhaust gas stream fed via the inlet pipe is removed through the main outlet pipe at partial load of the internal combustion engine.

4. A muffler in accordance with claim 1, wherein a flow cross section of the gap in an overlapping area is, on average, about equal to a flow cross section of the main outlet pipe.

5. A muffler in accordance with claim 1, wherein the housing has a cylindrical configuration and has a jacket as well as two end panels;

the inlet pipe passes through the jacket;

the main outlet pipe passes through the one end panel; and the secondary outlet pipe passes through the other end panel.

6. A muffler in accordance with claim 1, wherein the inlet pipe is unperforated; or the main outlet pipe is unperforated or the secondary outlet pipe unperforated; or any combination of the inlet pipe is unperforated and the main outlet pipe is unperforated and the secondary outlet pipe unperforated.

7. A muffler in accordance with claim 2, wherein the inlet pipe has a perforation in the overlapping area.

8. A muffler in accordance with claim 1, wherein:

at least one additional chamber is formed in the housing; and the inlet pipe has perforations or the secondary outlet pipe has perforations or both the inlet pipe has perforations and the secondary outlet pipe has perforations, at least in the additional chamber.

9. A muffler in accordance with claim 1, further comprising:

a sound-absorbing material;

a perforated first partition in the housing; and an unperforated second partition in the housing, wherein:

a first additional chamber is formed in the housing that axially adjoins the expansion chamber via the first partition;

a second additional chamber is formed in the housing that axially adjoins the first additional chamber via the second partition, on a side facing away from the expansion chamber;

the first additional chamber is configured as an absorption chamber filled with the sound-absorbing material, and is acoustically coupled with the expansion chamber via the perforated first partition; and the second additional chamber is configured as a resonator chamber, which is separated from the first additional chamber via the unperforated second partition and is acoustically connected to the secondary outlet pipe or to the expansion chamber via a resonator tube.

10. A muffler in accordance with claim 1, wherein the main outlet pipe is radially supported in the overlapping area at the inlet pipe.

11. A muffler in accordance with claim 10, further comprising a plurality of webs, wherein the main outlet pipe is supported at the inlet pipe via the plurality of webs, which are arranged distributed in the circumferential direction of the main outlet pipe and bridge over the gap.

12. A muffler in accordance with claim 10, further comprising at least one perforated ring, wherein the main outlet pipe is supported at the inlet pipe via the at least one perforated ring, which extends in a circumferential direction of the main outlet pipe and fills the gap.

13. A muffler in accordance with claim 1, further comprising a perforated intermediate panel wherein the main outlet pipe is supported at the perforated intermediate panel, which is arranged in the expansion chamber and is supported at the housing.

14. A muffler in accordance with claim 1, further comprising a control device controlling an opening of the main outlet pipe at least at full load of the internal combustion engine and a closing the main outlet pipe at least at a low partial load, whereby the main outlet pipe is flow controlled.

15. An exhaust system for an internal combustion engine, the exhaust system comprising:

an exhaust line, which leads from at least one branch of an exhaust manifold to at least one tail pipe; and a muffler connected to the exhaust line, the muffler comprising:

a housing, in which an expansion chamber is formed;

an inlet pipe extending into the housing and introducing exhaust gas from the exhaust line into the housing, the inlet pipe having an end section with an outlet opening in the expansion chamber;

a main outlet pipe extending into the housing and removing exhaust gas from the housing, the main outlet pipe having an initial section which protrudes into the end section of the inlet pipe;

a gap formed in an overlapping area between the end section of the inlet pipe and the initial section of the main outlet pipe and which forms a bypass, through which exhaust gas can flow from the inlet pipe into the expansion chamber, which bypass bypasses the initial section of the main outlet pipe in the end section of the inlet pipe; and a secondary outlet pipe having an inlet opening in the expansion chamber and removing exhaust gas from the housing.

16. An exhaust system in accordance with claim 15, wherein:

the end section of the inlet pipe and the initial section of the main outlet pipe each have a straight configuration;

an axial length of the overlapping area is at least twice a diameter of the end section of the inlet pipe; and a flow cross section of the gap in an overlapping area is, on average, about equal to a flow cross section of the main outlet pipe.

17. An exhaust system in accordance with claim 15, wherein flow cross sections or flow resistances or both flow cross sections and flow resistances of the main outlet pipe, the secondary outlet pipe and the gap are coordinated with one another such that 40% to 60% of the exhaust gas stream fed via the inlet pipe is removed through the main outlet pipe at partial load of the internal combustion engine.

18. An exhaust system in accordance with claim 15, wherein:

at least one additional chamber is formed in the housing; and the inlet pipe has perforations or the secondary outlet pipe has perforations or both the inlet pipe has perforations and the secondary outlet pipe has perforations, at least in the additional chamber.

19. An exhaust system in accordance with claim 15, further comprising:

a sound-absorbing material;

a perforated first partition in the housing; and an unperforated second partition in the housing, wherein:

a first additional chamber is formed in the housing, that axially adjoins the expansion chamber via the first partition;

a second additional chamber is formed in the housing, that axially adjoins the first additional chamber via the second partition, on a side facing away from the expansion chamber;

the first additional chamber is configured as an absorption chamber filled with the sound-absorbing material, and is acoustically coupled with the expansion chamber via the perforated first partition; and the second additional chamber is configured as a resonator chamber, which is separated from the first additional chamber via the unperforated second partition and is acoustically connected to the secondary outlet pipe or to the expansion chamber via a resonator tube.

20. An exhaust system in accordance with claim 15, further comprising a control device controlling an opening of the main outlet pipe at least at full load of the internal combustion engine and a closing the main outlet pipe at least at a low partial load, whereby the main outlet pipe is flow controlled.

* * * * *